US007591715B2

(12) United States Patent
Cybulski et al.

(10) Patent No.: US 7,591,715 B2
(45) Date of Patent: Sep. 22, 2009

(54) SANDING TOOL WITH SHEET LOADING FEATURE

(75) Inventors: Eric R. Cybulski, Woodbury, MN (US); Jon A. Kirschhoffer, White Bear Lake, MN (US); Ryan Patrick Simmers, Cottage Grove, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 11/201,763

(22) Filed: Aug. 11, 2005

(65) Prior Publication Data

US 2007/0087673 A1 Apr. 19, 2007

(51) Int. Cl.
*B24B 23/00* (2006.01)

(52) U.S. Cl. ..... 451/354; 451/514; 451/524

(58) Field of Classification Search ..... 451/354, 451/514, 515, 523, 524, 525, 519, 522
See application file for complete search history.

(56) References Cited

U.S. PATENT DOCUMENTS

| | | | | | |
|---|---|---|---|---|---|
| 734,927 | A | * | 7/1903 | McAfee | 451/522 |
| 751,117 | A | * | 2/1904 | Swaggerty | 451/523 |
| 2,095,495 | A | * | 10/1937 | Enge | 451/522 |
| 2,749,679 | A | | 6/1956 | Antcn | |
| 3,546,822 | A | * | 12/1970 | Hutchins | 451/344 |
| 3,822,518 | A | * | 7/1974 | Sjostrand | 451/516 |
| 4,062,152 | A | * | 12/1977 | Mehrer | 451/344 |
| 4,077,165 | A | | 3/1978 | Hutchins | |
| 5,168,672 | A | | 12/1992 | Grégoire, Sr. | |
| 6,613,113 | B2 | | 9/2003 | Minick et al. | |
| 2003/0104777 | A1 | | 6/2003 | Deshler | |

FOREIGN PATENT DOCUMENTS

| | | | | |
|---|---|---|---|---|
| DE | 198 00 044 A1 | | 9/1998 | |
| GB | 628980 | * | 9/1949 | 451/518 |
| WO | WO 2006/121617 A1 | | 11/2006 | |

* cited by examiner

*Primary Examiner*—Robert Rose
(74) *Attorney, Agent, or Firm*—David B. Patchett

(57) ABSTRACT

A hand-held, manually-operated sanding tool including a base member, a clamping mechanism, and a tab. The clamping mechanism is pivotally mounted to the base member, in alignment with a contact surface thereof such that the clamping mechanism pivots between a closed position and an open position in which a gap is defined between the clamping mechanism and the contact surface. The tab extends at least partially between the contact surface and the clamping mechanism, and establishes a stop surface that positively positions an edge of a sheet of abrasive material relative to an end of the base member as part of a loading operation.

26 Claims, 4 Drawing Sheets

SANDING TOOL WITH SHEET LOADING FEATURE

BACKGROUND

The present invention relates generally to hand-held, manually-operated sanding tools for use with a replaceable sheet of abrasive material such as sandpaper. More particularly, it relates to sanding tools that are easy to load and related methods of use.

Abrasive sheets, such as conventional sandpaper, are commonly used to hand-sand or finish a work surface, such as a wooden surface. With hand-sanding, the user holds the sandpaper directly in his/her hand and then moves the sandpaper across the work surface. Sanding by hand can, of course, be an arduous task. To facilitate the hand-sanding process, the sandpaper can instead be retained by a sanding block or tool sized to fit within the user's hand. The sanding block or tool thus makes hand-sanding faster and easier. One example of a commercially-available sanding block is the 3M™ Rubber Sanding Block available from 3M Company of Saint Paul, Minn.

U.S. Pat. No. 5,168,672 describes another exemplary sanding block or tool in the form of an abrasive sheet holder having a base provided with clamping shoulders formed in a pair of opposed side edges thereof. A handle is detachably secured over a rear surface of the base. The handle has opposed flexible flange walls for clamping opposed end edge portions of an abrasive paper sheet that is otherwise positioned over a front working surface of the base, with the edge portions of the paper sheet extending over the clamping shoulders.

Additionally, U.S. Patent Application Publication No. 2003/0104777 describes a sanding block or tool including a generally rectangular base housing upon which a multi-contoured, generally convex hand-grip is secured. The hand-grip further defines inwardly extending concave portions that facilitate easy and secure grasping by the user. Further, an over-center lever clamp mechanism is operative at each end of the sanding block to secure the opposed ends of a sandpaper sheet in a releasable manner.

While well-accepted, known sanding blocks may have certain shortcomings. For example, it is desirable that the sheet of abrasive material be tensioned or tightly fit about the sanding block. If the sheet is not tight, it may wrinkle, and the wrinkles may snag on the work surface and cause the abrasive sheet to tear. In addition, wrinkles may cause the work surface to be damaged or sanded unevenly. These concerns arise with flexible flat sheets of abrasive material, such as conventional sandpaper, as well as with resilient flexible abrasive sheets that are thicker than conventional sandpaper, such as the sheet-like abrasive materials described in, for example, Minick et al., U.S. Pat. No. 6,613,113. Unfortunately, the mechanisms by which conventional sanding blocks or tools effectuate loading of the abrasive sheet do not consistently achieve the desired, tensioned fit.

In particular, the common technique by which known sanding blocks are loaded with an abrasive sheet generally entails securing opposing ends of the abrasive sheet to opposite sides of the sanding block. With one approach, a user attempts to simultaneously secure the opposing ends of the abrasive sheet to the sanding block while at the same time tensioning the abrasive sheet. This requires considerable dexterity, and often times the user is unable to achieve satisfactory results. Alternatively, the user can sequentially mount a first end portion of the abrasive sheet to one side of the sanding block, wrap the abrasive sheet about a bottom of the sanding block, and then secure the second end portion of the sheet to the opposite side of sanding block. A tension is theoretically created and maintained while wrapping the sheet about the bottom. While this technique is physically easier to perform, it can be equally frustrating for the user. Namely, it is difficult at best to properly estimate the amount (i.e., length) of the first end portion of the abrasive sheet to initially secure to the first side of the sanding block such that when the abrasive sheet is wrapped about the bottom, a proper length remains for securement to the opposing side of the sanding block. For example, if an excessive length of the abrasive sheet is initially secured to the sanding block, there may not be a sufficient length remaining to wrap about the sanding block and secure to the opposing side thereof. Conversely, if too short a length of the abrasive sheet is initially secured to the sanding block, it may be problematic to secure the second end to the opposing side of the sanding block as the excessive, remaining length that interferes with proper functioning of the securement mechanism; similarly, it may be impossible to achieve desired tensioning of the abrasive sheet, again due to the excessive remaining length. In either case, the user is required to release the first end from the sanding block and try again. Clearly, this can be frustrating for the user.

In light of the above, a need exists for a sanding tool that is comfortable and easy to consistently and satisfactorily load with a sheet of abrasive material in a manner that tightly secures the abrasive sheet without unnecessary slack.

SUMMARY

Principles of the present invention overcome the above-identified limitations in the field by providing a sanding tool that is easy to load with abrasive media and securely holds the abrasive media in a tensioned manner. The tool is able to accommodate different types, widths, and thicknesses of sheet-like abrasive material. In addition, the tool is simple to operate, requiring no special auxiliary tools, and is designed to be easy to manufacture and assembled.

Aspects of the present invention relate to a hand-held, manually-operated sanding tool for use with a replaceable sheet-like abrasive material. The sanding tool includes a base member, a clamping mechanism, and a tab. The base member defines first and second ends, a bottom surface, and a contact surface formed opposite the bottom surface and extending from the first end. The clamping mechanism includes a mounting section, a front section, and a gripping surface. The mounting section is pivotally connected to the base member at a pivot point that associates the gripping surface with the contact surface. In particular, the clamping mechanism is movable relative to the base member between an open position and a closed position. In the open position, the front section of the clamping mechanism is spaced from the contact surface to establish a gap between the gripping surface and the upper contact surface. To this end, the gap is provided to receive an end portion of a sheet of abrasive material as part of a loading operation. Conversely, in the closed position, the front section of the clamping mechanism is more proximate to the upper contact surface as compared to the open position. Finally, the first tab extends partially between the clamping mechanism and the upper contact surface with the clamping mechanism in the open position. In this regard, the tab provides a stop surface establishing a trailing side of the gap. With this configuration, the stop surface facilitates proper positioning of the abrasive sheet when loading between the clamping mechanism and the contact surface.

In one embodiment, the tab projects from the upper contact surface, with the clamping mechanism including a pivoting member forming an aperture through which a portion of the tab extends while in the closed position. In other embodiments, a pair of laterally aligned side tabs are provided, projecting from either the clamping mechanism or the upper contact surface. In yet other embodiments, the tab is provided as part of a clamping mechanism configured to lock the locking mechanism relative to the base member in the closed position.

Other aspects in accordance with the principles of the present invention relate to a method of attaching a sheet of abrasive material to a hand-held, manually-operated sanding tool. The method includes providing a sanding tool including a base member, a clamping mechanism, and a tab. The base member defines first and second ends, a bottom surface extending there between, and first and second contact surfaces formed opposite the bottom surface and extending from the first and second ends, respectively. The clamping mechanism is pivotally mounted to the base member and includes a gripping surface. More particularly, the clamping mechanism is positioned such that the gripping surface is associated with the first contact surface. Finally, the tab extends at least partially between the clamping mechanism and the first contact surface. A sheet of abrasive material is also provided. The sheet of abrasive material has opposing, first and second edges. The clamping mechanism is transitioned to an open position to establish a gap between the gripping surface and the first contact surface. The first edge of the sheet of abrasive material is inserted into the gap to a location at which the first edge contacts the tab. The clamping mechanism is transitioned to a closed position in which the first edge of the sheet of abrasive material is secured to the sanding tool. The sheet of abrasive material is wrapped around the first end of the base member and along the bottom surface. Finally, the second end of the sheet of abrasive material is secured to the second contact surface. With this methodology, a user consistently achieves satisfactory abrasive material sheet loading onto the sanding tool in a straightforward manner without repeated attempts. In one embodiment, a longitudinal position of the tab relative to the first end of the base corresponds with a standardized length of the sheet of abrasive material such that following securement of the first edge of the sheet of abrasive material to the sanding tool, a sufficient length of the abrasive material sheet remains for wrapping about the base member and securement to the second contact surface.

DETAILED DESCRIPTION

Figure 1:
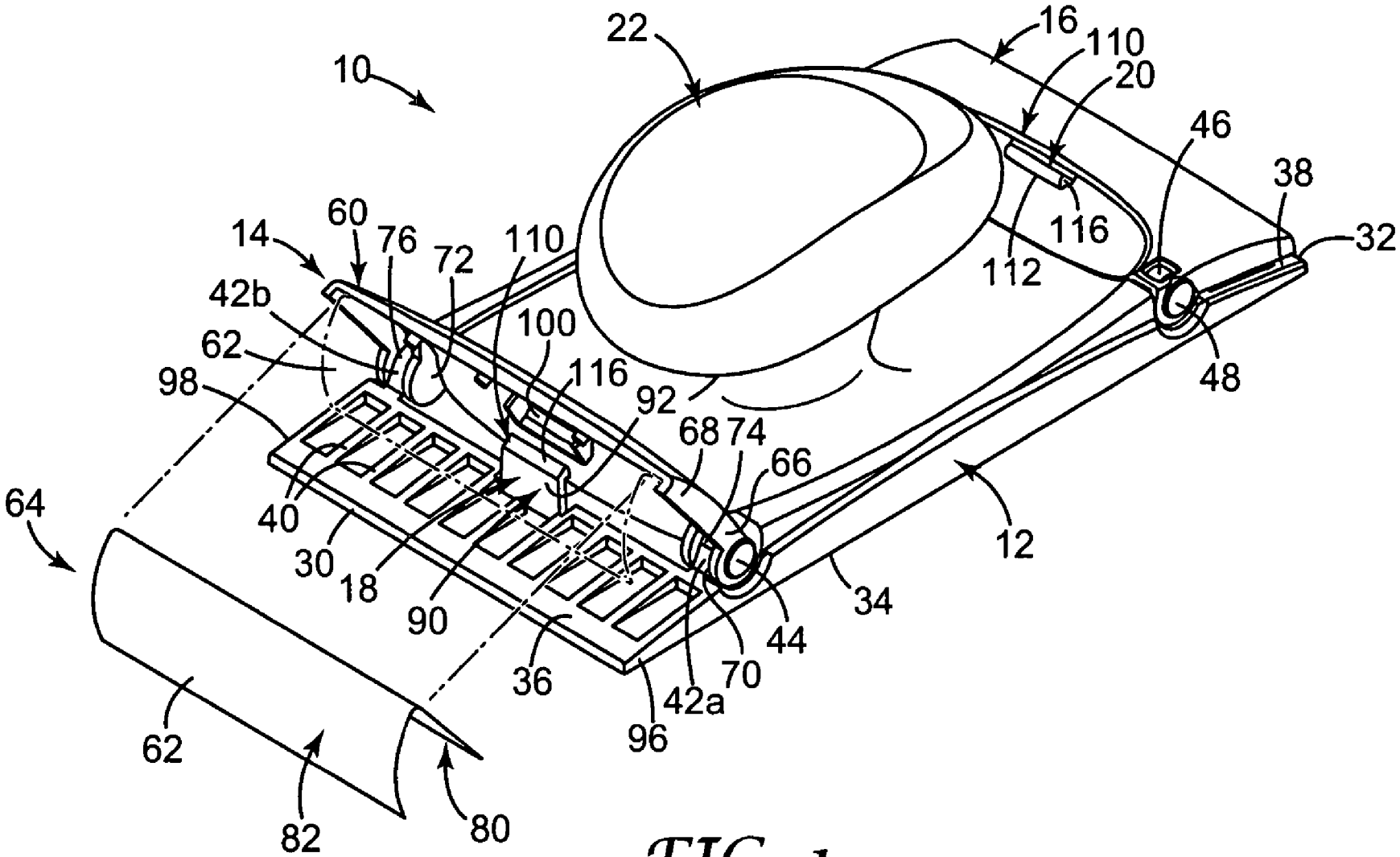
FIG. 1 is a perspective, partially-exploded view of a hand-held, manually-operated sanding tool according to principles of the present invention.

One embodiment of a hand-held, manually-operated sanding tool or sanding block 10 is shown in FIG. 1. The term "manually-operated" refers to the fact that the tool 10 is not a power tool. That is, all of the power for the tool 10 is provided by a user (not shown), and the tool 10 itself does not include a motor. It will be recognized, however, that principles of the present invention may be applied to a power tool and are not necessarily limited to manually-operated sanding tools.

The sanding tool 10 is described below as being useful with sheet-like abrasive material. As used throughout this specification, the terms "sheet-like abrasive material" and "sheet of abrasive material" are used interchangeably and refer to thin, flexible, generally square or rectangular sheets of abrasive material having discrete ends (or edges) that can be attached to a sanding block. Such sheet-like abrasive material include, for example, conventional sandpaper, flexible sanding scrims, non-woven abrasive materials such as Scotch-Brite™ available from 3M Company, St. Paul, Minn., and thin flexible abrasive sheet materials such as those described in U.S. Pat. No. 6,613,113 (Minick et al.), the entire contents of which are hereby incorporated by reference. The tool 10 may also find use with non-abrasive sheet-like materials such as dust removing tack cloths. However, the terms "sheet-like abrasive material" and "sheet of abrasive material" do not include so-called endless belts of abrasive material commonly used with power sanding tools, die cut sheets for power detail sanding tools, or abrasive sheets having their own attachment means, such as adhesive or hook-and-loop fasteners, that independently facilitate attachment to a tool.

With the above in mind, in one embodiment, the sanding tool 10 includes a base member 12, first and second clamping mechanisms 14, 16, and first and second alignment devices 18, 20. In some embodiments, the sanding tool 10 further optionally includes a handle 22. As made clear below, the base member 12, the clamping mechanism(s) 14 and/or 16, and the alignment device(s) 18 and/or 20 can assume a wide variety of forms apart from that shown in FIG. 1 in accordance with the principles of the present invention. Regardless, and in general terms, the first and second clamping mechanisms 14, 16 are pivotally associated with opposing ends, respectively, of the base member 12. The first alignment device 18 extends at least partially between the base member 12 and the first clamping mechanism 14, whereas the second alignment device 20 extends at least partially between the base member 12 and the second clamping mechanism 16. During use, and as described in greater detail below, the first and second alignment devices 18, 20 promote consistent loading of a sheet of abrasive material (not shown) with the clamping mechanisms 14, 16 in a simplified manner.

In one embodiment, the base member 12 defines first and second opposed ends 30, 32, and a generally planar bottom surface 34 against which a sheet of abrasive material (not shown) extends. While the base member 12 is illustrated in FIG. 1 as having a generally rectangular shape, a variety of other shapes can be provided that lend themselves for use with conventional sheet-like abrasive materials. For example, the base member 12 can be configured such that one or both of the first and second ends 30, 32 define a triangular or curved shape. Further, the first and second ends 30, 32 need not be identical in shape.

In one embodiment, regardless of an overall shape, the base member 12 forms a first upper contact surface 36 opposite the bottom surface 34 and extending from the first end 30. Though generally hidden in FIG. 1, a second upper contact surface 38 (referenced generally) is similarly formed opposite the bottom surface 34, extending from the second end 32. In one embodiment, the upper contact surfaces 36, 38 are angled or inclined. In this manner, the upper contact surfaces 36, 38 and the bottom surface 34 form an acute angle relative to the associated end 30, 32, respectively. In the illustrated embodiment, the contact surfaces 36, 38 are defined by the exposed upper surfaces of a plurality of spaced ribs 40 (shown for the first contact surface 36 in FIG. 1). With this one configuration, the contact surface area between the sheet-like abrasive material (not shown) and the associated contact surface 36 or 38 is decreased (as compared to a continuous surface), thereby allowing the sheet to slide upwardly along the respective contact surfaces 36, 38 more readily to tension the sheet-like abrasive material as described below. Alternatively, the first and/or second contact surfaces 36 and/or 38 can be defined in a variety of other manners, need not be identical and need not necessarily be angled or inclined relative to the bottom surface 34.

As described below, the base member 12 is configured to facilitate pivoting or rotational attachment thereto by the first and second clamping mechanisms 14, 16. For example, in one embodiment, the base member 12 forms a pair of posts 42*a*, 42*b* adjacent the first contact surface 36 (opposite the first end 30). The posts 42*a*, 42*b* are laterally aligned (relative to a length of the base member 12) and are configured to receive a corresponding component associated with the first clamping member 14 in a manner allowing for rotation of the first clamping mechanism 14 relative to the posts 42*a*, 42*b*. A wide variety of other structure(s) and/or mechanisms can be provided for rotatably connecting the first clamping mechanisms 14 to the base member 12. Regardless, a pivot point 44 (referenced generally) is established by the base member 12 about which the first clamping mechanism 14 rotates or pivots. In one embodiment in which the first and second clamping mechanisms 14, 16 are similarly constructed, the base member 12 forms a second set of posts 46 (one of which is partially illustrated in FIG. 1) for rotatably receiving corresponding features of the second clamping mechanism 16. Once again, a pivot point 48 is established, and a wide variety of other configurations can be used in place of the posts 46. Even further, in alternative embodiments, the second clamping mechanism 16 is not substantially similar to the first clamping mechanism 14 and/or is replaced with a conventional mechanism for securing the sheet-like abrasive material to the second end 32 of the base member 12, such that the posts 46 can be eliminated.

In one embodiment, the first and second clamping mechanism 14, 16 are identical. Thus, the following description of the first clamping mechanism 14 applies equally to the second clamping mechanism 16, it being understood that with other embodiments, the second clamping mechanism 16 has a different construction and/or can be replaced, for example, with a conventional sheet securement mechanism. With this in mind, the clamping mechanism 14 includes a pivoting member 60 and a gripping surface 62 (shown with phantom lines of FIG. 1) provided by, with the one embodiment of FIG. 1, a tensioning member 64 (it being understood that the tensioning member 64 is illustrated apart from the pivoting member 60 in FIG. 1). The pivoting member 60 and the tensioning member 64 can assume a wide variety of forms varying from that shown in FIG. 1. In general terms, however, the pivoting member 60 forms a mounting section 66 and a front section 68. The mounting section 66 is configured for pivotable or rotatable connection to the base member 12. Upon final assembly, the gripping surface 62 extends from the front section 68.

In one embodiment, the pivoting member 60 is an integral or unitary body, with the mounting section 66 including first and second pairs 70, 72 of legs, each defining a slot 74, 76 (reference generally). The slots 74, 76 are sized to receive a corresponding one of the posts 42*a*, 42*b* provided with the base member 12 such that the corresponding pair of legs 70, 72 are rotatably secured to the posts 42*a*, 42*b*, respectively, upon final assembly. Alternatively, and as mentioned above, the pivoting member 60 can be configured to include a variety of other structure(s) and/or mechanisms adapted to facilitate rotatable or pivotable connection of the pivoting member 60 to the base member 12.

In one embodiment, the tensioning member 64 is a thin flexible strip of metal, for example, forming a leaf spring-like configuration, that generally returns to the orientation shown in FIG. 1. For example, in one embodiment, the tensioning member 64 includes a support wall 80 and a gripping wall 82. The support wall 80 is configured for attachment to the pivoting member 60. The gripping wall 82 extends from the support wall 80 and defines the gripping surface 62. Upon final assembly, then, the gripping wall 82, and thus the gripping surface 62, extends inwardly (i.e., toward the contact surface 36) from the front section 68 of the pivoting member 60. Alternatively, the gripping surface 62 can be provided with a variety of other configurations. For example, the tensioning member 64, and in particular the gripping wall 82, can assume a variety of other forms varying from that shown in FIG. 1. Even further, the gripping surface 62 can be provided as an integral, unitary portion of the pivoting member 60.

While the first and second clamping mechanisms 14, 16 have been described as being identical, in other embodiments, the second clamping mechanism 16 can have an entirely different configuration. For example, the second clamping mechanism 16 can be replaced with a conventional mechanism for securing a sheet of abrasive material (not shown) to the tool 10.

Figure 2:
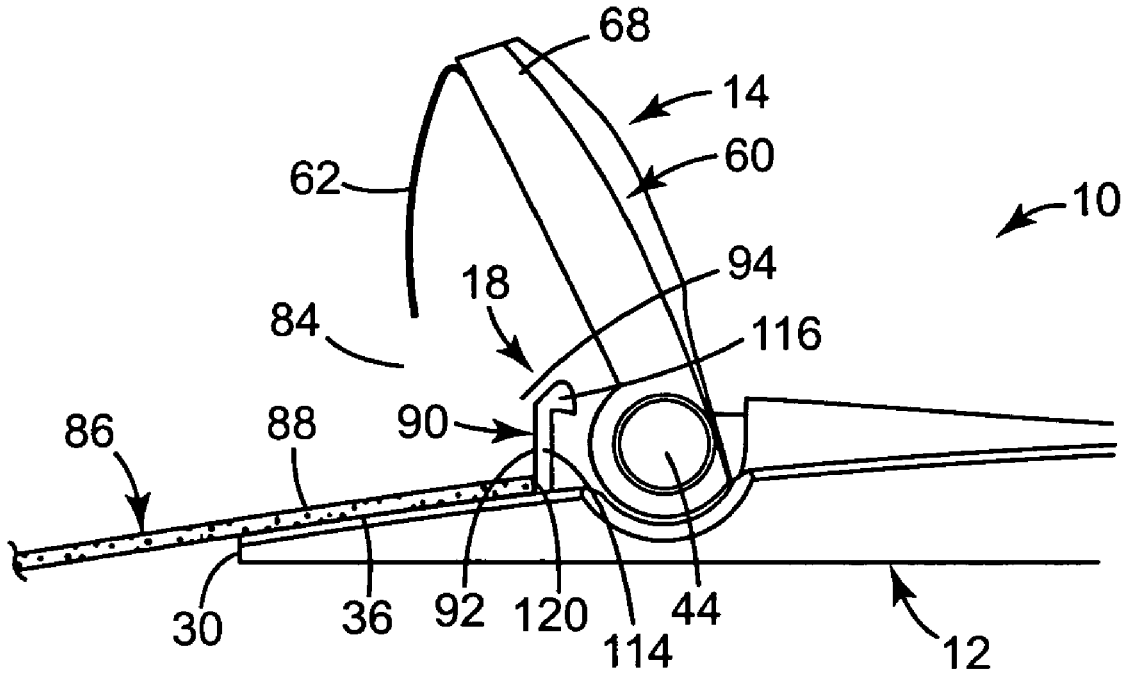
FIG. 2 is a side view of a portion of the sanding tool of FIG. 1, illustrating initial loading of a sheet-like abrasive material.

Upon final assembly, and with additional reference FIG. 2, the first clamping mechanism 14 is rotatably connected to the base member 12. This construction allows the first clamping mechanism 14 to pivot (at the pivot point 44) between an open position as shown in FIG. 2 and a closed position (shown for the second clamping mechanism 16 in FIG. 1). In the open position, the front section 68 of the pivoting member 60 is spaced from the first contact surface 36, establishing a gap 84 (referenced generally) between the first clamping mechanism 14 (and in particular, the gripping surface 62) and the first contact surface 36. In the open position, then, a sheet-like abrasive material 86, and in particular a first end portion 88 thereof, can be inserted within the gap 84 for subsequent securement to the first contact surface 36 via the first clamping mechanism 14.

With the above general description in mind, the first alignment device 18 provides a positive stop surface for facilitating proper placement of the sheet-like abrasive material 86 (FIG. 2) relative to the first end 30 of the base member 12. With continued reference to FIGS. 1 and 2, and in one embodiment, the first and second alignment devices 18, 20 are similarly configured such that the following description of the first alignment device 18 equally applies to the second alignment device 20. Alternatively, and as described in greater detail below, the first and second alignment devices 18, 20 can assume different forms; even further, the second alignment device 20 can be eliminated.

In one embodiment, the first alignment device 18 includes a tab 90 extending at least partially between the first contact surface 36 and the first clamping mechanism 14. In particular, with the one embodiment of FIGS. 1 and 2, the tab 90 projects upwardly (relative to an orientation of FIGS. 1 and 2) from the first contact surface 36 toward the first clamping mechanism 14. The tab 90 and the base member 12 can be integrally formed as a unitary body; alternatively, the tab 90 can be separately formed and assembled to the base member 12. Regardless, the tab 90 is longitudinally positioned (relative to a length of the base member 12) between the first end 30 and the pivot point 44. More particularly, the tab 90 defines a stop surface 92 otherwise spaced from the first end 30. The stop surface 92 is positioned forward of the pivot point 44 such that the sheet-like abrasive material 86 (FIG. 2), otherwise traversing along the first contact surface 36, will interface with the stop surface 92, and thus not extend to the pivot point 44. Thus, the tab 90, and in particular the stop surface 92, effectively defines a trailing side 94 (referenced generally in FIG. 2) of the gap 84 (i.e., longitudinally opposite an entrance side of the gap 84 generally defined at the first end 30). In one embodiment, a longitudinal distance between the stop surface 92 and the first end 30 correlates with a length of the base member 12 (i.e., distance between the first and second ends 30, 32), as well as, in some embodiments, with an expected, standardized length of the sheet-like abrasive material 86 intended to be used with the sanding tool 10. In particular, and as described in greater detail below, a longitudinal length between the stop surface 92 and the first end 30 is such that when the sheet-like abrasive material 86 is disposed against the stop surface 92, a sufficient length remains for wrapping about the first end 30, along the bottom surface 34, and into engagement with the second contact surface 38.

As best shown in FIG. 1, the tab 90 is, in one embodiment, laterally offset from opposing sides 96, 98 of the first contact surface 36. For example, the tab 90 can be laterally centered relative to the opposing sides 96, 98 (i.e., relative to a width of the first contact surface 36). This one preferred location increases a likelihood that during an abrasive sheet loading operation, the stop surface 92 will be contacted by the sheet-like abrasive material 86 (FIG. 2). Alternatively, other locations are also acceptable as described below.

In one embodiment, the first clamping mechanism 14 is configured to accommodate the tab 90 in the closed position (shown for the second clamping mechanism 16 in FIG. 1). For example, the pivoting member 60 forms an aperture 100 sized and positioned such that upon final assembly, the aperture 100 is aligned with the tab 90, and permits passage of the tab 90 through the aperture 100 as the pivoting member 60 transitions from the open position to the closed position. Alternatively, projection of the tab 90 from the first contact surface 36 can be reduced from that shown in FIGS. 1 and 2, such that the aperture 100 need not be included. Preferably, however, the tab 90 is of a fairly significant height so as to ensure interface with the sheet-like abrasive material 86 (FIG. 2) otherwise being loaded to the first contact surface 36.

The tab 90 further forms, in one embodiment, a portion of a locking mechanism 110 (referenced generally in FIG. 1) that selectively locks or secures the first clamping mechanism 14 in the closed position (i.e., shown for the second clamping mechanism 16). In particular, the locking mechanism 110 includes, in one embodiment, the tab 90, the aperture 100, and an engagement surface 112. To this end, the tab 90 is formed to include a finger 114 (FIG. 2, otherwise forming the stop surface 92) and a latch body 116. The latch body 116 extends from the finger 114 opposite the contact surface 36, preferably in a direction away from the first end 30. The engagement surface 112 (best shown in FIG. 1 for the second clamping mechanism 16) is defined at a perimeter of the aperture 100. With this configuration, in the closed position, the finger 114 extends through the aperture 100, with the latch body 116 abutting against the engagement surface 112, such that the tab 90 secures the first clamping mechanism 14 relative to the base member 12. In one embodiment, to facilitate passage of the latch body 116 through the aperture 100 as the pivoting member 60 transitions from the open position to the closed position, as well as to permit selectively disengagement of the latch body 116 from the engagement surface 112, the tab 90 can be slightly deflectable from the upright orientation illustrated in FIG. 1. With this construction, then, the latch body 116 can be forced slightly toward the first end 30, via deflection of the finger 114, to permit passage through the aperture 100. Alternatively, the locking mechanism 110 can assume a variety of other forms, and need not be identical relative to the first and second clamping mechanisms 14, 16. In some embodiments, a locking mechanism is not provided for one or both of the clamping mechanisms 14 and/or 16.

While the first alignment device 18 has been described as including the tab 90, other configurations can be employed, several examples of which are provided below. For example, the stop surface 92 can be defined by one or more other structures that may or may not be tabs (e.g., a continuous or discontinuous bump or flange). Regardless, the first alignment device 18 is configured to provide the stop surface 92 as defining the trailing side 94 of the gap 84 for assisting in proper positioning of the sheet-like abrasive material 86 relative to the first end 30 as part of a loading operation described below.

With specific reference to FIG. 2, loading of the sheet-like abrasive material 86 to the tool 10 begins with transitioning of the first clamping mechanism 14 to an open position such that the gap 84 is formed. The first end portion 88 of the sheet-like abrasive material 86 (otherwise terminating at an edge 120) is manually inserted by a user (not shown) into the gap 84. In particular, with the first clamping mechanism 14 in the open position, the first end portion 88 is inserted into the gap 84 at or about the first end 30 and positioned along the first contact surface 36. In this regard, the first end portion 88 is maneuvered or directed within the gap 84 (i.e., away from the first end 30) until the edge 120 contacts or abuts against the stop surface 92 provided by the tab 90. Further movement of the edge 120 beyond the stop surface 92 (i.e., closer to the pivot point 44) is thus impeded, ensuring that a desired length of the sheet-like abrasive material 86 is within the gap 84 and that the edge 120 will not interfere with subsequent movement of the clamping mechanism 14 at the pivot point 44.

Figure 3:
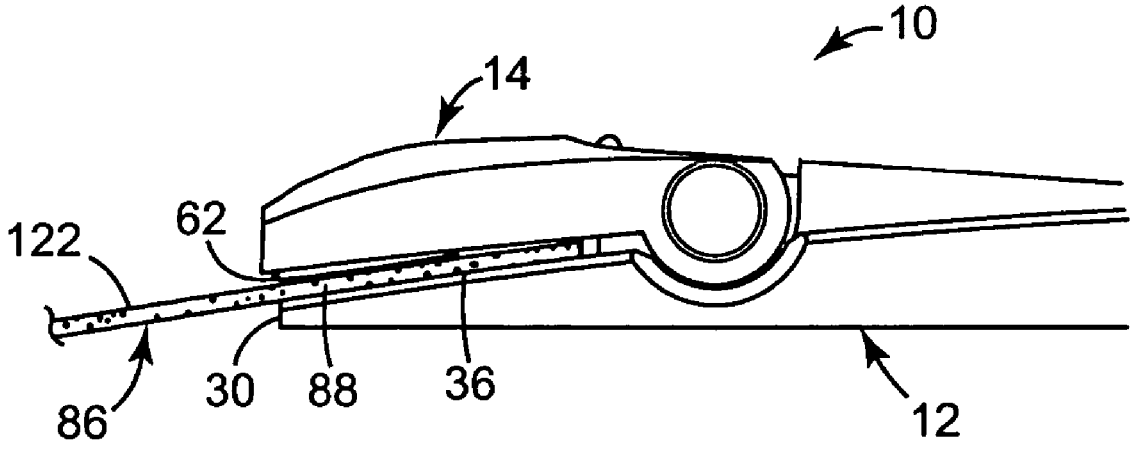
FIG. 3 is a side view of the portion of FIG. 2 with the clamping mechanism in a closed position.
Figure 4:
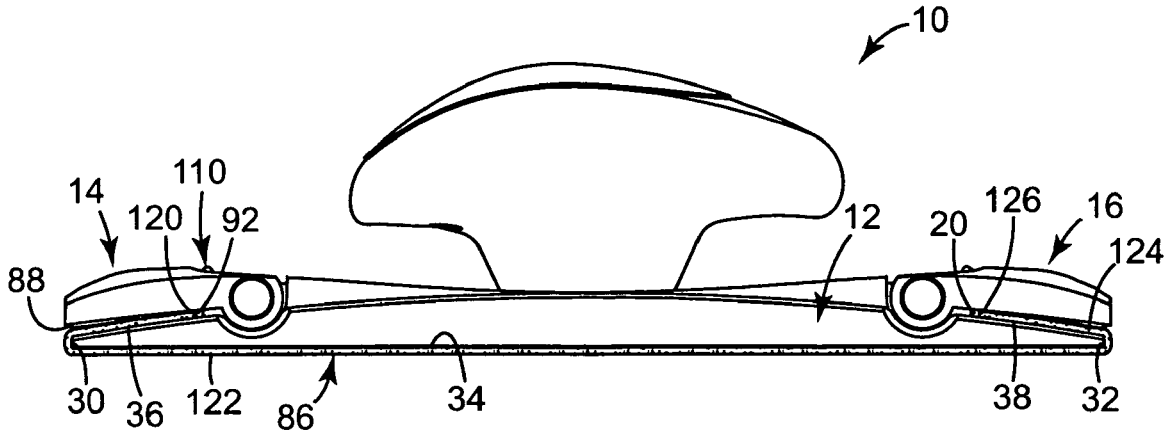
FIG. 4 is a side view of the tool of FIG. 1 loaded with a sheet-like abrasive material.

With the first end portion 88 properly located within the gap 84, the first clamping mechanism 14 is then transitioned (e.g., rotated) to a closed position as shown in FIG. 3. In the closed position, the gripping surface 62 engages the sheet-like abrasive material 86, frictionally capturing the first end portion 88 between the gripping surface 62 and the first contact surface 36. In one embodiment, the first end portion 88 may slide slightly along the incline defined by the first contact surface 36 via contact with the gripping surface 62. Regardless, the first end portion 88 is secured to the tool 10, with a remainder 122 (reference generally) of the sheet-like abrasive material 86 freely extending from the first end 30 of the base member 12. With reference to FIG. 4, the remainder 122 of the sheet-like abrasive material 86 is then wrapped about the first end 30, along the bottom surface 34, and directed toward the second end 32. A second end portion 124 of the sheet-like abrasive material 86 is then secured to the second contact surface 38, for example via the second clamping mechanism 16 in a manner similar to that previously described with respect to operation of the first clamping mechanism 14. While an edge 126 defined by the second end portion 124 is shown in FIG. 4 as approximately contacting the second alignment device 20, this relationship is not required. That is to say, securement of the second end portion 124 to the tool 10 can be accomplished independent of an exact length of material actually extending along the second contact surface 38. Regardless, a user is able to tension the sheet-like abrasive material 86 about the bottom surface 34 (i.e., because the first end portion 88 is secured to the tool 10, the user can "pull" on the remainder 122 while wrapping), resulting in a tight, tensioned fit.

The first alignment device 18 allows a user to employ the above-described sequential loading technique, confident that following securement of the first end portion 88, the remainder 122 (FIG. 3) is of sufficient length to "reach" the second end 32. This is especially applicable to instances in which the sheet-like abrasive material 86 used with the sanding tool 10 is an off-the-shelf product having a standardized length. For example, but in no way limiting, sheet-like abrasive materials are commonly sold having a length of 9 inches (either full size sheets (e.g., 9"×11") that a user can tear to a desired width, or partial size sheets having a decreased width). Regardless, with this standardized length in mind, a longitudinal location of the stop surface 92 relative to the first end 30 is selected to ensure that a sufficient length of the sheet-like abrasive material 86 (i.e., the remainder 122 described with reference to FIG. 3) is available for wrapping about the bottom surface 34 and engagement with the second contact surface 38 (e.g., via the second clamping mechanism 16). That is to say, appropriate loading of a standardized length of sheet-like abrasive material 86 can be consistently achieved by initially locating the edge 120 against the stop surface 92; the user is then assured that enough length remains for attachment to the second contact surface 38.

In one embodiment, in the closed position, the locking mechanism 110 (referenced generally in FIG. 4) operates to secure the first clamping mechanism 14 relative to the base member 12, thus preventing unintentional dislodgement of the first end portion 88 from the sanding tool 10. The second clamping mechanism 16 is also locked in a closed position via a separate locking mechanism.

Figure 5:
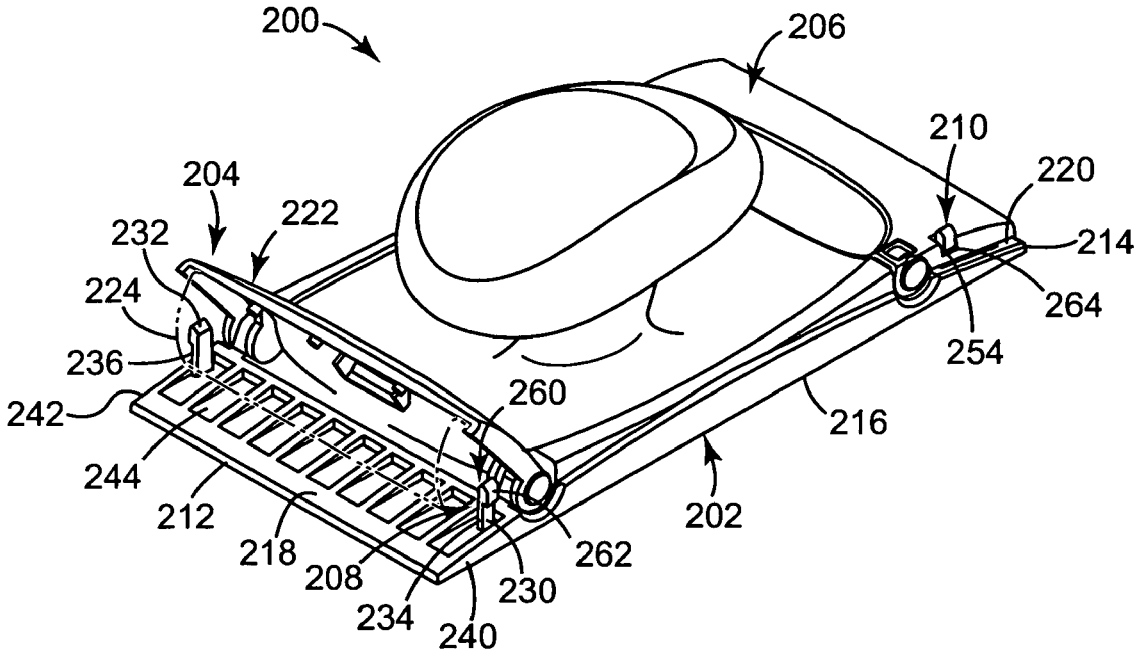
FIG. 5 is a perspective view of another embodiment hand-held, manually-operated sanding tool according to principles of the present invention.

While the sanding tool 10 has been described as forming the first and second alignment devices 18, 20 to each include a single tab (i.e., the tab 90) that is otherwise laterally centered relative to a width of the corresponding contact surface, in alternative embodiments, two or more tabs can be employed. For example, FIG. 5 illustrates an alternative embodiment sanding tool 200 including a base member 202, a first clamping mechanism 204, a second clamping mechanism 206, a first alignment device 208, and a second alignment device 210 (referenced generally). The base member 202, the first clamping mechanism 204, and the second clamping mechanism 206 are highly similar to the corresponding components described above with respect to the sanding tool 10 (i.e., the base member 12, the first clamping mechanism 14, and the second clamping mechanism 16, respectively, of FIG. 1). Thus, for example, the base member 202 defines first and second ends 212, 214, a bottom surface 216, and first and second upper contact surfaces 218, 220. The clamping mechanisms 204, 206 each include, in one embodiment, a pivoting member 222 pivotally attached to the base member 202 adjacent the corresponding first or second end 212 or 214, and maintaining a gripping surface 224 (shown in phantom in FIG. 5). In addition, similar to the alignment devices 18, 20 (FIG. 1) previously described, the alignment devices 208, 210 facilitate desired loading of a sheet-like abrasive material (not shown). However, unlike the embodiment of FIG. 1, the sanding tool 200 forms the alignment devices 208, 210 to include a pair of tabs as described below.

The alignment devices 208, 210 are identical in one embodiment, such that the following description of the first alignment device 208 applies equally to the second alignment device 210; alternatively, the alignment devices 208, 210 can have different constructions or the second alignment device 210 can be eliminated. With this in mind, the first alignment device 208 includes a first tab 230 and a second tab 232. The first and second tabs 230, 232 project upwardly from the first contact surface 218, each forming a stop surface 234, 236, respectively. In this regard, the first tab 230 is positioned at or adjacent a first side 240 of the base member 202 (otherwise defining a first side of the contact surface 218), whereas the second tab 232 is positioned at or adjacent an opposite, second side 242 of the base member 202. In one embodiment, the first and second tabs 230, 232 are similarly configured, with the stop surfaces 234, 236 being laterally aligned. That is to say, the stop surfaces 234, 236 are formed at an identical longitudinal distance from the first end 212. Thus, the stop surfaces 234, 236 define a trailing side (unnumbered) of a gap 244 (referenced generally) otherwise formed when the first clamping mechanism 204 is in the open position shown. As previously described, then, a sheet-like abrasive material (not shown) is properly located or positioned within the gap 244 by locating an end thereof against the stop surfaces 234, 236.

In one embodiment, to accommodate a desired height of the tabs 230, 232, the alignment device 208 further includes first and second apertures formed by the pivoting member 222. Though hidden in the view of FIG. 5, a first one of the apertures is shown at 254 of the pivoting member 222 associated with the second clamping mechanism 206. Upon final assembly, respective ones of the apertures are aligned with corresponding ones of the tabs 230, 232 such that when the clamping mechanism 204 is transitioned to a closed position, the first and second tabs 230, 232 at least partially project through the corresponding aperture. Finally, in one embodiment, the first and second tabs 230, 232 form portions of a locking mechanism 260 (referenced generally). In particular, each of the tabs 230, 232 forms a latch body 262 that otherwise abuts against a corresponding engagement surface 264 (referenced generally for the second clamping mechanism 206) when the clamping mechanism 204 is in the closed position as previously described.

Figure 6:
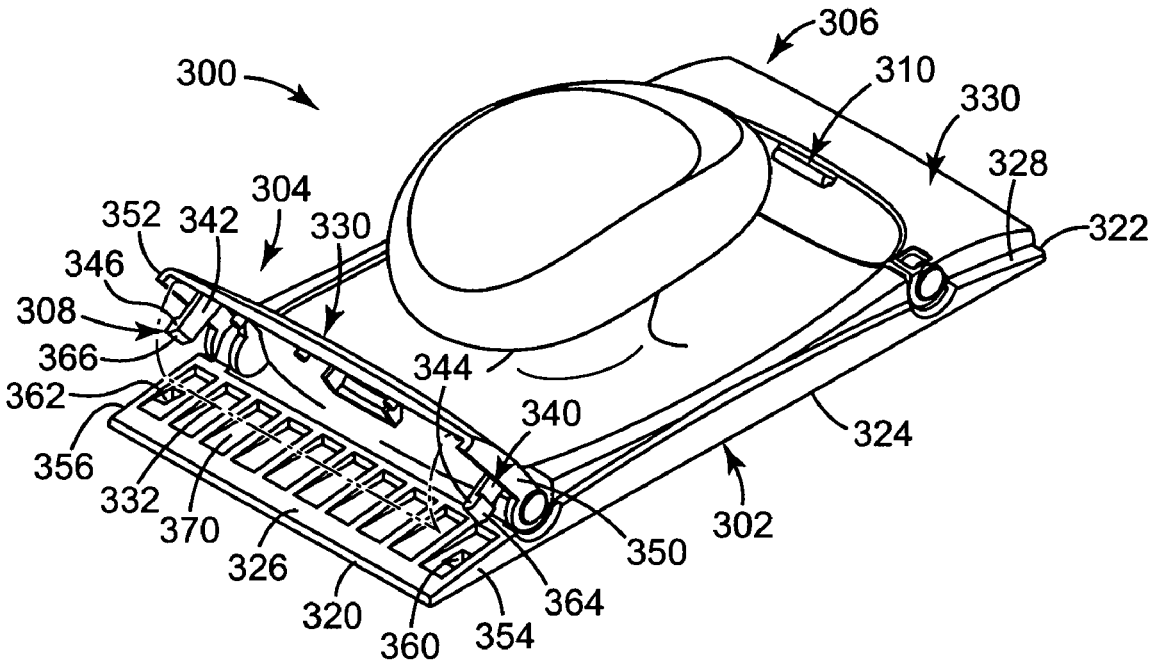
FIG. 6 is a perspective view of another embodiment hand-held, manually-operated sanding tool according to principles of the present invention.

While the sanding tools 10 (FIG. 1), 200 have been described as defining an alignment device(s) as including one or more tabs projecting from the contact surface provided by the base member (e.g., the tabs 230, 232 of FIG. 5), in alternative embodiments, the tab(s) can project from the corresponding clamping mechanism. For example, the tab 90 of FIG. 1 can project from the first clamping mechanism 14 (e.g., integrally formed with the pivoting member 60 as a unitary body). Additionally, FIG. 6 illustrates another embodiment sanding tool 300 in accordance with principles of the present invention. Similar to previous embodiments, the sanding tool 300 includes a base member 302, first and second clamping mechanisms 304, 306, a first alignment device 308, and a second alignment device 310 (referenced generally). The base member 302 is similar to the base member 12 (FIG. 1) previously described and defines first and second ends 320, 322, a bottom surface 324, and first and second upper contact surfaces 326, 328. The clamping mechanisms 304, 306 include a pivoting member 330 rotatably attached to the base member 302 adjacent a corresponding one of the ends 320, 322, respectively, and maintaining a gripping surface 332 (shown in phantom in FIG. 6). The first and second alignment devices 308, 310, similar to previous embodiments, facilitate the proper loading of a sheet-like abrasive material (not shown). To this end, the second alignment device 310 is similar to the alignment device 18 (FIG. 1) previously described, whereas the first alignment device 308 has the differing structure described below; alternatively, the alignment devices 308, 310 can be identical.

With the embodiment of FIG. 6, the first alignment device 308 includes first and second tabs 340, 342. Each of the tabs 340, 342 defines a stop surface 344, 346 that otherwise faces, upon final assembly, the first end 320 of the base member 302. Unlike previous embodiments, the first and second tabs 340, 342 project from the first clamping mechanism 304, and in particular the pivoting member 330. The tabs 340, 342 are provided as integral, unitary extensions of the pivoting member 330; alternatively, the tabs 340, 342 can be separately formed and assembled to the pivoting member 330. Regardless, the first tab 340 is positioned adjacent to or at a first side 350 of the pivoting member 330, whereas the second tab 242 is positioned at or adjacent a second side 352. This, in turn, dictates that upon final assembly, the first tab 340 is laterally positioned adjacent a first side 354 of the base member 302, whereas the second tab 342 is laterally positioned at or adjacent a second side 356 of the base member 302. With this in mind, the stop surfaces 344, 346 are laterally aligned relative to a length of the upper contact surface 326. That is to say, a longitudinal distance between the first end 320 and the stop surfaces 340, 342 is substantially the same.

To accommodate a desired height or length of the tabs 340, 342, in one embodiment the base member 302 forms first and second apertures 360, 362 that are positioned to receive respective ones of the tabs 340, 342 when the first clamping mechanism 304 is transitioned to the closed position. Thus, upon final assembly of the first clamping mechanism 304 to the base member 302, the first tab 340 is spatially aligned with the first aperture 360 and the second tab 342 is spatially aligned with the second aperture 362.

Finally, in one embodiment, each of the tabs 340, 342 forms a latch body 364, 366 as part of a locking mechanism (unnumbered). In the closed position, the tabs 340, 342 extend partially through a corresponding one of the apertures 360, 362 with the latch body 364, 366 contacting an engagement surface (not shown) provided by the base member 302, thus securing the first clamping mechanism 304 relative to the base member 302 in the closed position.

Loading of the sanding tool 300 with the sheet-like abrasive material (not shown, but akin to the sheet of abrasive material 86 shown in FIGS. 2-4) is similar to that previously described. In particular, the first clamping mechanism 304 is transitioned to an open position as shown in FIG. 6, whereby a gap 370 (referenced generally) is formed between the first clamping mechanism 304 and the first contact surface 326. In this regard, the first clamping mechanism 304 is rotatably positioned such that the tabs 340, 342 are in close proximity to the first upper contact surface 326 and may even partially extend into the corresponding aperture 360 or 362. As a point of reference, the first clamping mechanism 304 is depicted in FIG. 6 as being overtly rotated relative to the base member 302 to better illustrate various components of the tool 300. During an actual loading operation, however, the first clamping mechanism 304 is only slightly rotated away from the first contact surface 326 to ensure interface between the sheet-like abrasive material and the stop surfaces 344, 346 as the abrasive sheet is inserted within the gap 370 and manually maneuvered or directed along the contact surface 326.

An end portion of the sheet-like abrasive material (not shown) is then inserted within the gap 370 such that an edge thereof contacts the stop surfaces 344, 346. The first clamping mechanism 304 is then transitioned to the closed position, with the first clamping mechanism 304 being locked to the base member 302 via the tabs 340, 342 (and in particular, the latch bodies 364, 366) in some embodiments. Once again, a longitudinal spacing of the stop surfaces 344, 346 relative to the first end 320 ensures that a sufficient length of the sheet-like abrasive material (that in some embodiments is otherwise of a standardized length) extends from the first end 320 and is available for wrapping about the first end 320, along the bottom surface 324, and onto the second contact surface 328 for securement thereto via the second clamping mechanism 306.

Figure 7:
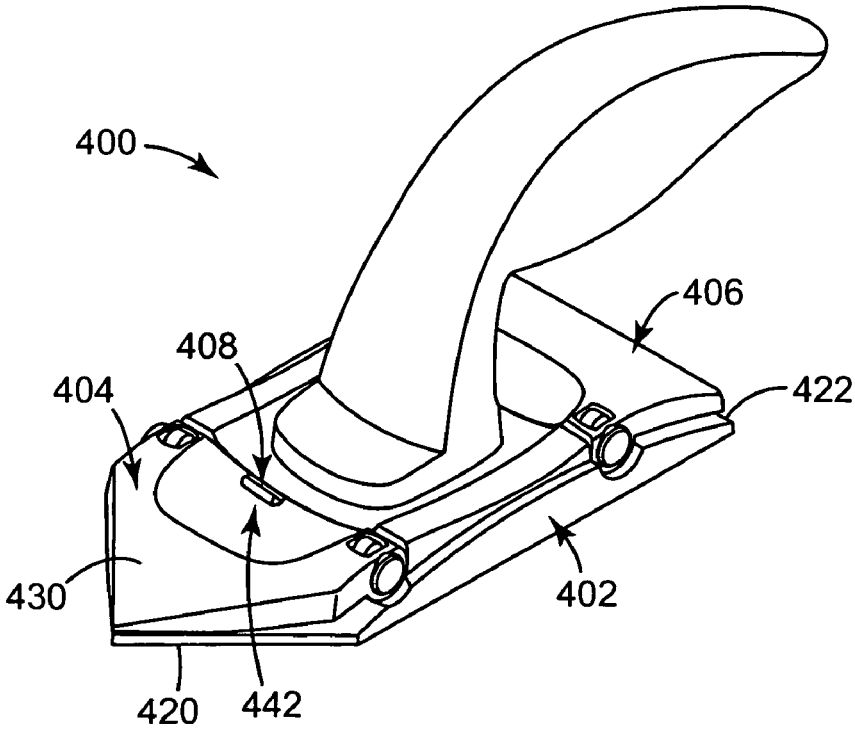
FIG. 7 is a perspective view of another embodiment hand-held, manually operated sanding tool according to principles of the present invention.

Another embodiment sanding tool 400 in accordance with principles of the present invention is shown in FIG. 7. The sanding tool 400 includes a base member 402, first and second clamping mechanisms 404, 406, and a first alignment device 408 (referenced generally). The base member 402 defines first and second ends 420, 422. Unlike previous embodiments, the first end 420 defines a triangular-like shape, with the first clamping mechanism 404, and in particular, a pivoting member 430 thereof, defining a similar shape. Conversely, the second end 422 has a rectangular- or square-like shape. The alignment device 408 is similar to the alignment device 18 (FIG. 1) previously described, and forms a portion of a locking mechanism 442 (referenced generally). Unlike previous embodiments, an additional alignment device is not provided with the second clamping mechanism 406.

The sanding tool in accordance with principles of the present invention provides a marked improvement over previous designs. In particular, the stop surface(s) associated with an alignment device otherwise included with the sanding tool serves as a positive stop mechanism for properly locating a sheet-like abrasive material when loading to the tool, and in some embodiments, assists in locking a corresponding clamping mechanism.

Although specific embodiments have been illustrated and described herein, it will be appreciated by those of ordinary skill in the art that a variety of alternate and/or equivalent implementations may be substituted for the specific embodiments shown and described without departing from the scope of the present invention. This application is intended to cover any adaptations or variations of the specific embodiments discussed herein. Therefore, it is intended that this invention be limited only by the claims and the equivalents thereof.

What is claimed is:

1. A hand-held, manually-operated sanding tool for use with a replaceable sheet-like abrasive material, the sanding tool comprising:

a base member defining first and second ends, a bottom surface extending between the first and second ends, and a first contact surface formed opposite the bottom surface and extending from the first end;

a clamping mechanism having a pivoting member defining a mounting section and a front section, and a gripping surface;

wherein the mounting section is pivotally connected to the base member at a pivot point that associates the gripping surface with the contact surface such that the clamping mechanism is movable between an open position, in which the front section is spaced from the first contact surface to establish a gap between the gripping surface and the first contact surface for receiving an end portion of a sheet of abrasive material, and a closed position in which the front section is more proximate the first contact surface; and a first tab including a finger and a latch body, an entirety of the latch body being immovably affixed to and extending from the finger, the first tab extending at least partially between the clamping mechanism and the first contact surface with the clamping mechanism in the open position, the first tab providing a stop surface establishing a trailing side of the gap;

wherein the finger projects from one of the base member and the pivoting member, and an other of the base member and the pivoting member forms an engagement surface defining an aperture that is sized to receive the latch body, the sanding tool configured such that when transitioning the clamping mechanism to the closed position the latch body passes through the aperture and contacts the engagement surface to lock the clamping mechanism in the closed position.

2. The sanding tool of claim 1, wherein the first tab projects from the first contact surface.

3. The sanding tool of claim 2, wherein the first tab that is positioned such that the stop surface is between the first end and the pivot point.

4. The sanding tool of claim 3, wherein the clamping mechanism forms an aperture sized in accordance with, and aligned relative to, the first tab such that in the closed position, a portion of the first tab extends into the aperture.

5. The sanding tool of claim 2, wherein the first tab and the base member are integrally formed as a unitary body.

6. The sanding tool of claim 1, wherein the first tab projects inwardly from the clamping mechanism and toward the first contact surface upon final assembly.

7. The sanding tool of claim 6, wherein the base member forms an aperture sized in accordance with, and aligned relative to, the first tab such that in the closed position, a portion of the first tab extends into the aperture.

8. The sanding tool of claim 6, wherein the first tab projects from the pivoting member in a direction of the gripping surface.

9. The sanding tool of claim 8, wherein the pivoting member and the first tab are integrally formed as a unitary body.

10. The sanding tool of claim 6, wherein the first tab is positioned such that the stop surface is longitudinally between the mounting section and the front section.

11. The sanding tool of claim 1, wherein upon final assembly, the first tab is laterally spaced from opposing sides of the contact surface.

12. The sanding tool of claim 11, wherein the first tab is laterally centered relative to the opposing sides of the first contact surface.

13. The sanding tool of claim 1, wherein upon final assembly, the first tab is laterally adjacent one of opposing sides of the first contact surface.

14. The sanding tool of claim 13, further comprising:

a second tab positioned opposite the first tab relative to a width of the first contact surface such that the second tab is laterally adjacent an other of the opposing sides of the first contact surface and provides a stop surface that is laterally aligned with the stop surface of the first tab.

15. The sanding tool of claim 1, wherein the finger projects from the contact surface and the latch body extends from the finger in a direction generally opposite the first end.

16. The sanding tool of claim 1, wherein the base member forms a second contact surface opposite the bottom surface and extending from the second end, the sanding tool further comprising:

a second clamping mechanism pivotally connected to the base member such that the second clamping mechanism is associated with the second contact surface; and a second tab extending at least partially between the second clamping mechanism and the second contact surface, the second tab providing a stop surface to position an end of a sheet of abrasive material inserted between the second clamping mechanism and the second contact surface.

17. A method of attaching a sheet-like abrasive material to a hand-held, manually-operated sanding tool, the method comprising:

providing a sanding tool including:

a base member defining first and second ends, a bottom surface extending between the first and second ends, a first contact surface formed opposite the bottom surface and extending from the first end, and a second contact surface formed opposite the bottom surface and extending from the second end, a clamping mechanism pivotally mounted to the base member, the clamping mechanism including a gripping surface that is associated with the first contact surface, a tab defining a finger and a latch body extending from the finger, the tab extending at least partially between the clamping mechanism and the first contact surface, the tab forming a stop surface facing the first end;

providing a replaceable sheet-like abrasive material defining opposing first and second edges;

transitioning the clamping mechanism to an open position to establish a gap between the gripping surface and the first contact surface;

inserting the first edge of the sheet-like abrasive material into the gap to a location at which the first end contacts the stop surface;

transitioning the clamping mechanism to a closed position including:

the latch body initially entering an aperture formed on one of the base member and the clamping mechanism, the aperture being circumscribed by a wall and wherein an engagement surface is formed immediately adjacent the aperture, the latch body slidably contacting the wall with transitioning of the clamping mechanism, forcing the finger to deflect solely in response to sliding contact between the latch body and the wall as the latch body passes through the aperture, contacting the latch body against the engagement surface to the engagement surface to secure the first edge of the sheet-like abrasive material to the first end of the sanding tool;

wrapping the sheet-like abrasive material around the first end of the base member and along the bottom surface of the base member; and securing the second edge of the sheet-like abrasive material to the second contact surface.

18. The method of claim 17, the sheet-like abrasive material has a standardized length, and further wherein a longitudinal position of the first tab relative to the first end of the base member corresponds with the standardized length such that upon positioning the first edge of the sheet-like abrasive material against the stop surface, a sufficient remaining length of the sheet-like abrasive material extends from the first end for wrapping about the bottom surface and positioning the second edge along the second contact surface.

19. The method of claim 17, further comprising:

locking the clamping mechanism to the base member in the closed position via the tab.

20. The sanding tool of claim 1, wherein the finger defines a first end and a second end opposite the first end, the first end connected to one of the base member and the pivoting member and the latch body extending from the second end.

21. The sanding tool of claim 1, wherein an entirety of the tab is sized for passage through the aperture.

22. A hand-held, manually-operated sanding tool for use with a replaceable sheet-like abrasive material, the sanding tool comprising:

a base member defining first and second ends, a bottom surface extending between the first and second ends, and a contact surface formed opposite the bottom surface and extending from the first end;

a clamping mechanism having a pivoting member and a gripping surface, the pivoting member pivotally connected to the base member at a pivot point that associates the gripping surface with the contact surface such that the clamping mechanism is movable between an open position in which a front section of the pivoting member is spaced from the contact surface to establish a gap between the gripping surface and the contact surface for receiving an end portion of a sheet of abrasive material, and a closed position in which the front section is more proximate the contact surface; and a first tab extending at least partially between the clamping mechanism and the contact surface with the clamping mechanism in the open position, the first tab providing a stop surface establishing a trailing side of the gap;

wherein upon final assembly, the first tab is laterally adjacent one of opposing sides of the contact surface.

23. The sanding tool of claim 1, wherein the engagement surface forms the aperture to have a closed perimeter.

24. The sanding tool of claim 1, wherein the finger is directly affixed to one of the base member and the pivoting member.

25. The sanding tool of claim 1, wherein the finger terminates at an end opposite the latch body, the end being directly affixed to the base member at a point of interface, and further wherein an entirety of the first tab is movable relative to the base member only by deflection of the finger at the point of interface.

26. The sanding tool of claim 1, wherein the aperture is defined by a back side and a front side, the engagement surface being contiguous with the back side and the back side being opposite the first end in the closed position, and further wherein the latch body has a major dimension in a direction commensurate with a width of the first contact surface, the major dimension being less than a length of the back side.

* * * * *